US011445838B1

(12) United States Patent
Ruedlinger

(10) Patent No.: US 11,445,838 B1
(45) Date of Patent: Sep. 20, 2022

(54) APPARATUS FOR DISPLAYING APPAREL

(71) Applicant: Matt Ruedlinger, Avon, IN (US)

(72) Inventor: Matt Ruedlinger, Avon, IN (US)

( * ) Notice: Subject to any disclaimer, the term of this patent is extended or adjusted under 35 U.S.C. 154(b) by 692 days.

(21) Appl. No.: 16/528,741

(22) Filed: Aug. 1, 2019

Related U.S. Application Data

(60) Provisional application No. 62/827,058, filed on Mar. 30, 2019.

(51) Int. Cl.
*A47F 8/02* (2006.01)
*A47G 1/06* (2006.01)
*A47F 3/00* (2006.01)

(52) U.S. Cl.
CPC ..... *A47F 8/02* (2013.01); *A47F 3/004* (2013.01); *A47G 1/06* (2013.01); *A47G 2001/0672* (2013.01)

(58) Field of Classification Search
CPC ..... A47F 8/02; A47F 8/00; A47G 2001/0672; A47G 1/12; A47G 25/28; B44C 5/04
USPC ..... 40/600, 538
See application file for complete search history.

(56) References Cited

U.S. PATENT DOCUMENTS 4,356,650 A * 11/1982 Antonczyk ..... B44C 5/02 40/800
4,739,911 A * 4/1988 Quinn ..... A47F 8/02 223/66
4,805,816 A * 2/1989 Freund ..... A47F 8/02 223/66
5,244,131 A * 9/1993 Hollingsworth ..... A47F 8/00 223/92
6,244,480 B1 * 6/2001 Sepulveda ..... A47F 8/00 223/120
6,732,462 B1 * 5/2004 Kramer ..... A47F 3/005 40/800
2004/0232177 A1 * 11/2004 Neiffer ..... A47F 8/00 223/66
2011/0271568 A1 * 11/2011 Vitale ..... H04N 5/64 348/E5.133
2012/0260551 A1 * 10/2012 Andrulewich ..... A47G 25/36 40/777
2013/0256174 A1 * 10/2013 Pickering ..... B65D 81/365 206/457
2014/0145567 A1 * 5/2014 Aldrich ..... A47G 1/12 312/111
2016/0022058 A1 * 1/2016 Atkinson ..... G09B 23/34 223/66
2016/0066714 A1 * 3/2016 Kunipo ..... A47G 1/0616 40/711
2016/0345765 A1 * 12/2016 Poirier ..... A47G 33/004

* cited by examiner

*Primary Examiner* — David R Dunn
*Assistant Examiner* — Christopher E Veraa
(74) *Attorney, Agent, or Firm* — Ice Miller LLP

(57) ABSTRACT

An apparatus for displaying apparel. The apparatus includes a three-dimensional apparel base that has a convex front surface, an opposing concave rear surface, and a plurality of magnetically active attachment points. The apparatus includes a backboard that has an anterior surface, an opposing posterior surface, and a plurality of magnets arranged on the anterior surface. The backboard magnetically couples to the three-dimensional apparel base by way of magnetic connections between two or more of the plurality of magnets and two or more of the plurality of magnetically active attachment points.

20 Claims, 11 Drawing Sheets

APPARATUS FOR DISPLAYING APPAREL

CROSS REFERENCE TO RELATED APPLICATIONS

The present application is a non-provisional of, and claims priority to, U.S. Provisional Patent Application No. 62/827,058, filed Mar. 30, 2019, the disclosure of which is incorporated by reference in its entirety.

BACKGROUND

Keepsake or collectable apparel, such as autographed jerseys and other apparel that is related to a specific team and/or player, can be a significant investment. Such apparel can cost a collector hundreds, thousands, and even tens of thousands dollars to acquire. However, the options available for displaying keepsake or collectable apparel are inadequate. The most common apparel display cases in use today consist of a frame structure with cloth backing on the inside so the collector can pin the apparel to the backing in the frame for display. Other varieties of apparel displays include an integrated clothing hanger that is affixed to the top of the inside of the frame for the article to hang from. In both instances, the apparel being displayed is flat and one-dimensional, and the frame structures that require hangers and/or pins can cause damage to the article of clothing, which is important to avoid especially in cases with valuable collectable apparel such as autographed jerseys.

For the foregoing reasons, it is desired to provide an improved solution for displaying collectable apparel.

SUMMARY

The present disclosure includes disclosure of apparatuses for displaying apparel. In at least one embodiment, an apparatus for displaying apparel according to the present disclosure comprises a three-dimensional apparel base, the three-dimensional apparel base comprising a convex front surface and an opposing concave rear surface, at least a portion of the concave rear surface terminating in a rim, the three-dimensional apparel base comprising a plurality of magnetically active attachment points arranged adjacent to the rim; a backboard, the backboard comprising a perimeter, an anterior surface, an opposing posterior surface, and a plurality of magnets arranged on the anterior surface adjacent to the perimeter, the backboard magnetically coupled to the three-dimensional apparel base by way of magnetic connections between two or more of the plurality of magnets and two or more of the plurality of magnetically active attachment points; and a display case, the display case comprising a frame and an enclosure, wherein the posterior surface of the backboard is removably affixed to the frame and the enclosure covers the three-dimensional apparel base and the backboard. In an aspect of an apparatus for displaying apparel according to the present disclosure, the convex front surface comprises a replica of the back torso of a male human. In an aspect of an apparatus for displaying apparel according to the present disclosure, the convex front surface comprises a replica of the front torso of a male human. In an aspect of an apparatus for displaying apparel according to the present disclosure, the convex front surface comprises a replica of the back torso of a female human. In an aspect of an apparatus for displaying apparel according to the present disclosure, the convex front surface comprises a replica of the front torso of a female human. In an aspect of an apparatus for displaying apparel according to the present disclosure, the backboard comprises an aperture therethrough. In an aspect of an apparatus for displaying apparel according to the present disclosure, the aperture comprises a notch. In an aspect of an apparatus for displaying apparel according to the present disclosure, the frame comprises a hanging knob. In an aspect of an apparatus for displaying apparel according to the present disclosure, the frame comprises a hanging knob, and wherein the posterior surface of the backboard is removably affixed to the frame by engaging the hanging knob and the notch. In an aspect of an apparatus for displaying apparel according to the present disclosure, the posterior surface of the backboard is removably affixed to the frame by magnetic forces.

The present disclosure includes disclosure of methods for displaying apparel. In at least one embodiment, a method for displaying apparel according to the present disclosure comprises the steps of providing a three-dimensional apparel base, the three-dimensional apparel base comprising a convex front surface and an opposing concave rear surface, at least a portion of the concave rear surface terminating in a rim, the three-dimensional apparel base comprising a plurality of magnetically active attachment points arranged adjacent to the rim; installing an article of apparel over the three-dimensional apparel base; stowing any excess material from the article of apparel in the concave rear surface; coupling a backboard to the three-dimensional apparel base in a manner securing the article of apparel in place, the backboard comprising a perimeter, an anterior surface, an opposing posterior surface, and a plurality of magnets arranged on the anterior surface adjacent to the perimeter, the backboard coupling to the three-dimensional apparel base by way of magnetic connections between two or more of the plurality of magnets and two or more of the plurality of magnetically active attachment points; and installing the article of apparel, the three-dimensional apparel base, and the backboard into the a display case, the display case comprising a frame and an enclosure, wherein the posterior surface of the backboard is removably affixed to the frame and the enclosure covers the article of apparel, the three-dimensional apparel base, and the backboard.

BRIEF DESCRIPTION OF THE DRAWINGS

The features and advantages of this disclosure, and the manner of attaining them, will be more apparent and better understood by reference to the following descriptions of the disclosed methods and systems, taken in conjunction with the accompanying drawings, wherein.

DESCRIPTION

Figure 1:
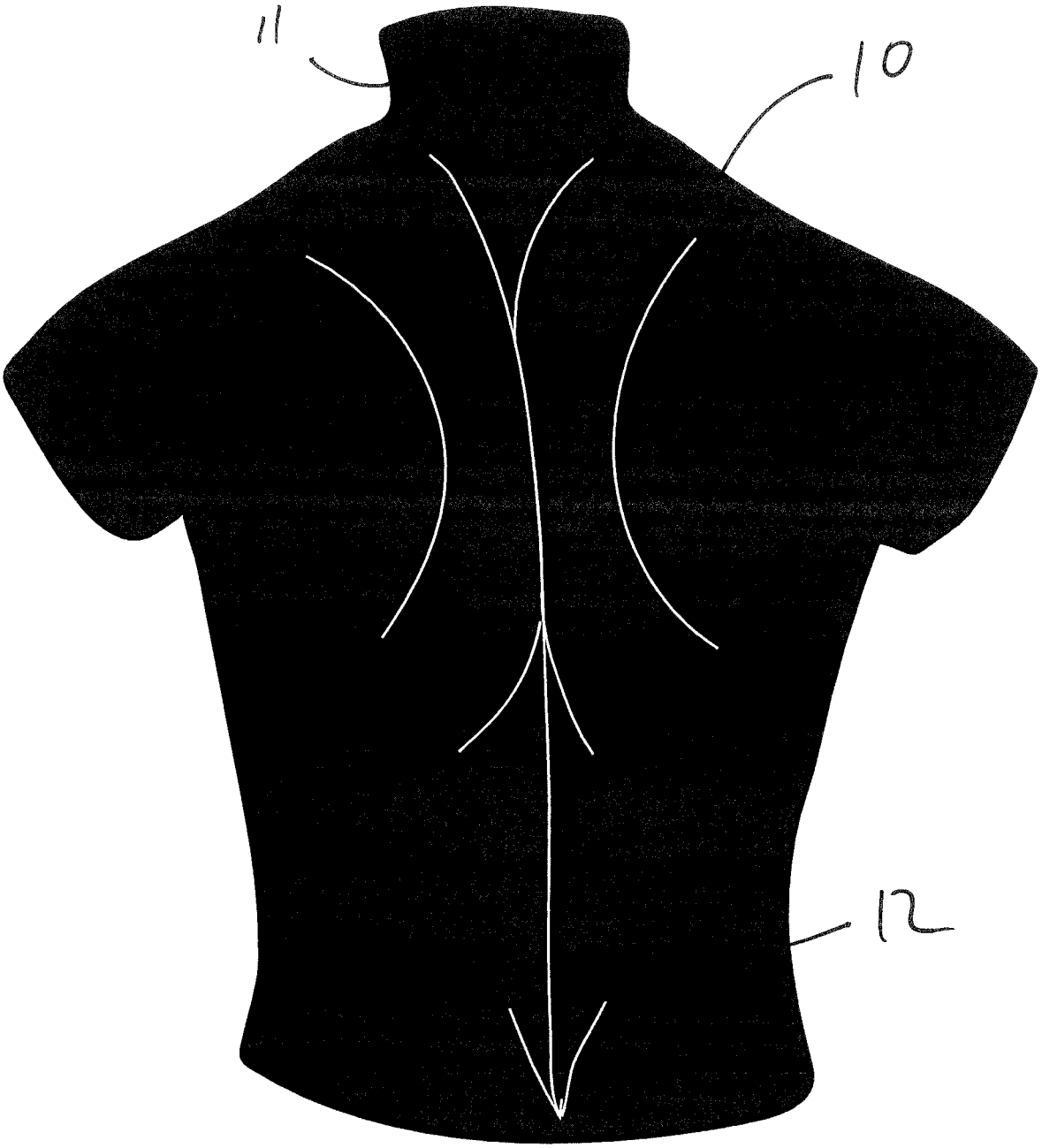
FIG. 1 shows a front view of a three-dimensional apparel base according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 shows a front view of three-dimensional apparel base 10, according to at least one embodiment of the present disclosure. According to such an embodiment of the present disclosure, three-dimensional apparel base 10 is a three dimensional replica of the upper torso of the human body. Shown in FIG. 1 is front surface 12 of three-dimensional display 10, which is convex in appearance.

In at least one embodiment, three-dimensional apparel base 10 is constructed of a rigid material, such as plastic, fiberglass, aluminum, and the like, that is molded into the desired shape and contours. As shown in FIG. 1, three-dimensional apparel base 10 is a replica of the back torso of a male human, and comprises neck 11. However, it is within the scope of the present disclosure that three-dimensional display 10 could be a replica of the front torso of a male human, a replica of the back torso of a female human, a replica of the front torso of a female human, a replica of the lower extremities of a male or female human, and the like.

Figure 2:
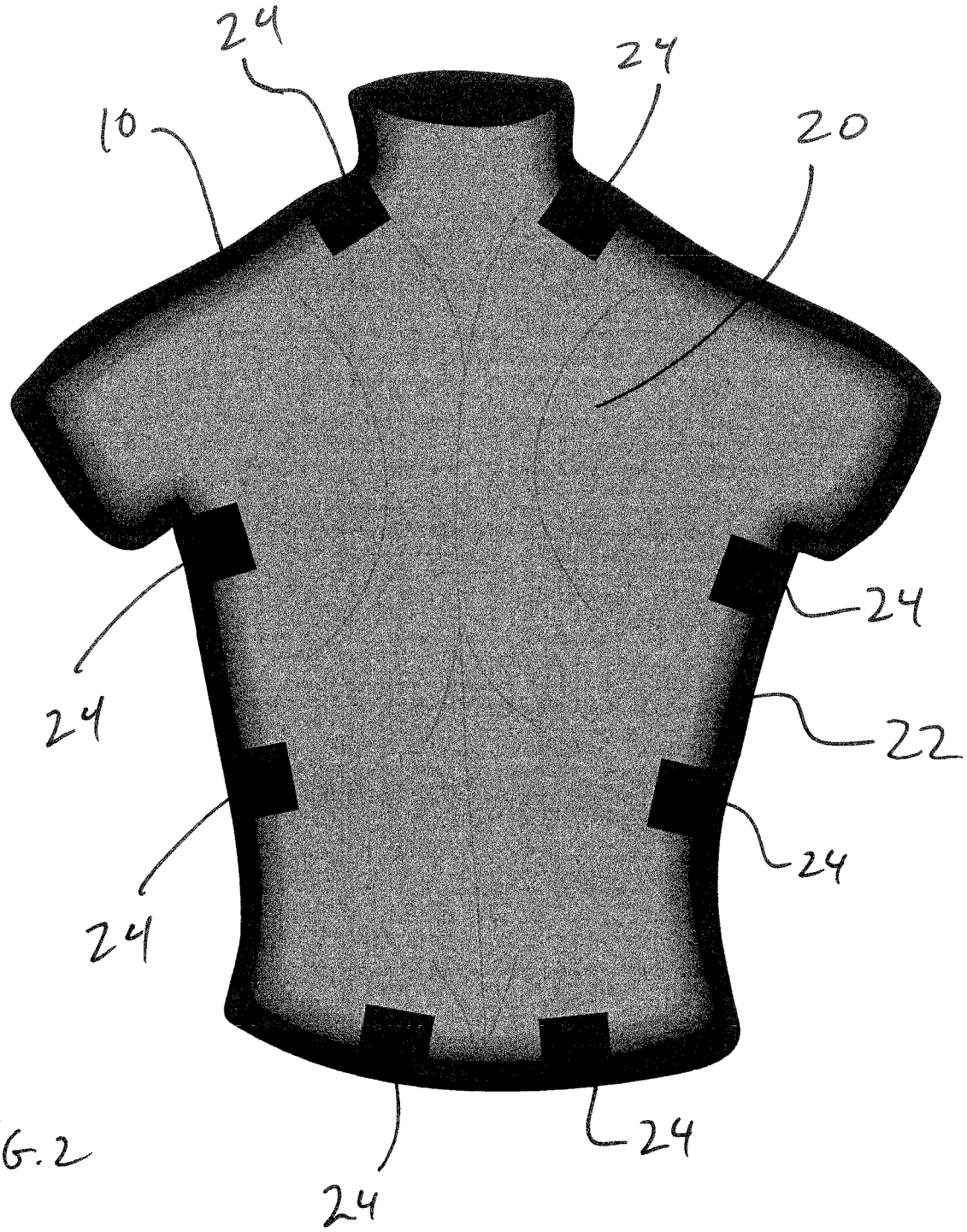
FIG. 2 shows a rear view of a three-dimensional apparel base according to at least one embodiment of the present disclosure.
Figure 10:
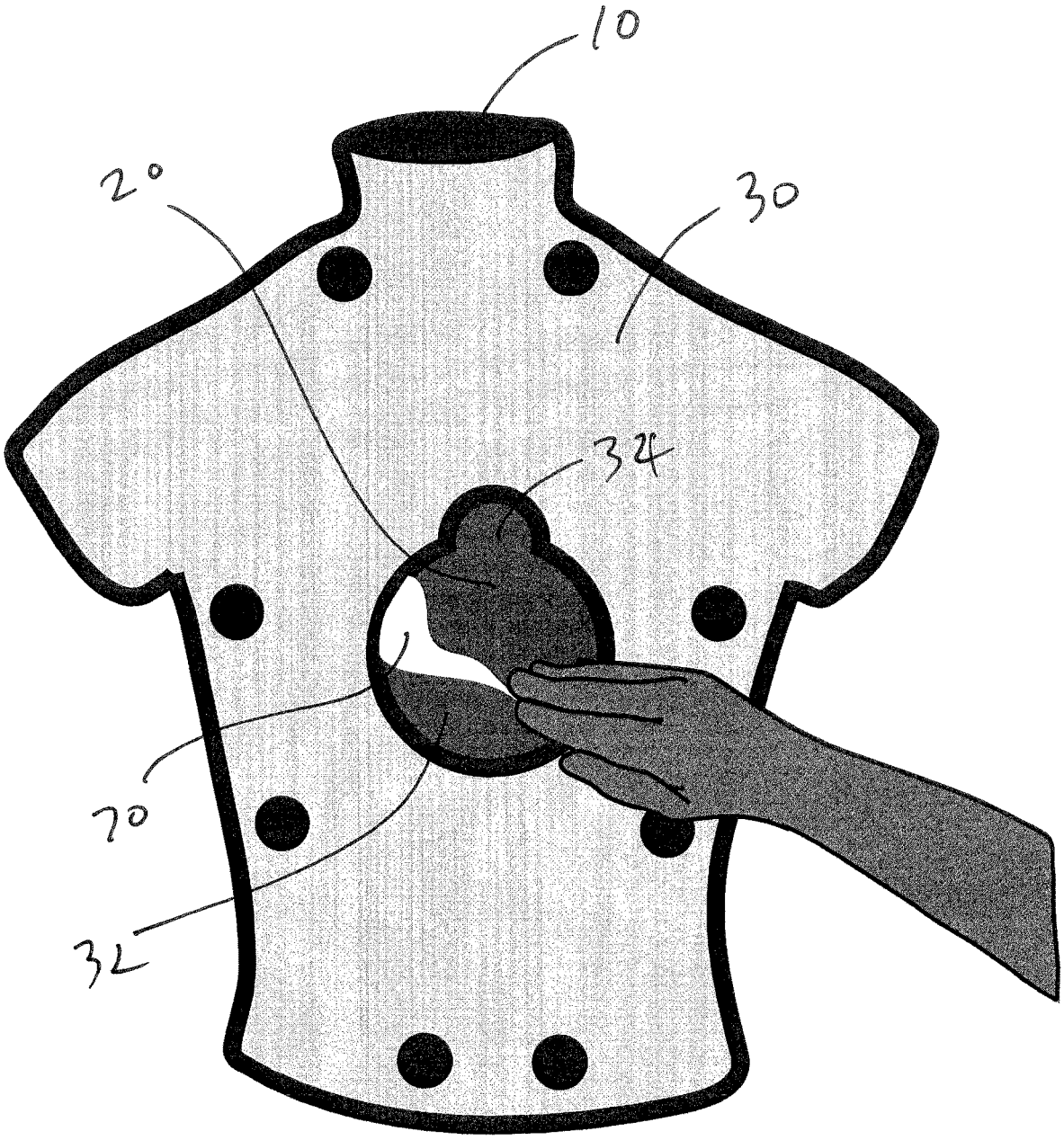
FIG. 10 shows the operation of an apparatus for displaying apparel according to at least one embodiment of the present disclosure.

FIG. 2 shows a rear view of three-dimensional apparel base 10, according to at least one embodiment of the present disclosure. Shown in FIG. 2 is concave rear surface 20 of three-dimensional apparel base 10. Also shown in FIG. 10 is rim 22, which extends around all or substantially all of the perimeter of rear surface 20. Arrayed around perimeter 22 are a plurality of attachment points 24, which in at least one embodiment are receptive to magnetic forces. In the embodiment of three-dimensional apparel base 10 shown in FIG. 2, eight attachment points 24 are shown. However, it is within the scope of present disclosure to have more than eight attachment points 24 or fewer than eight attachment points 24 in embodiments of three-dimensional apparel base 10.

Figure 3:
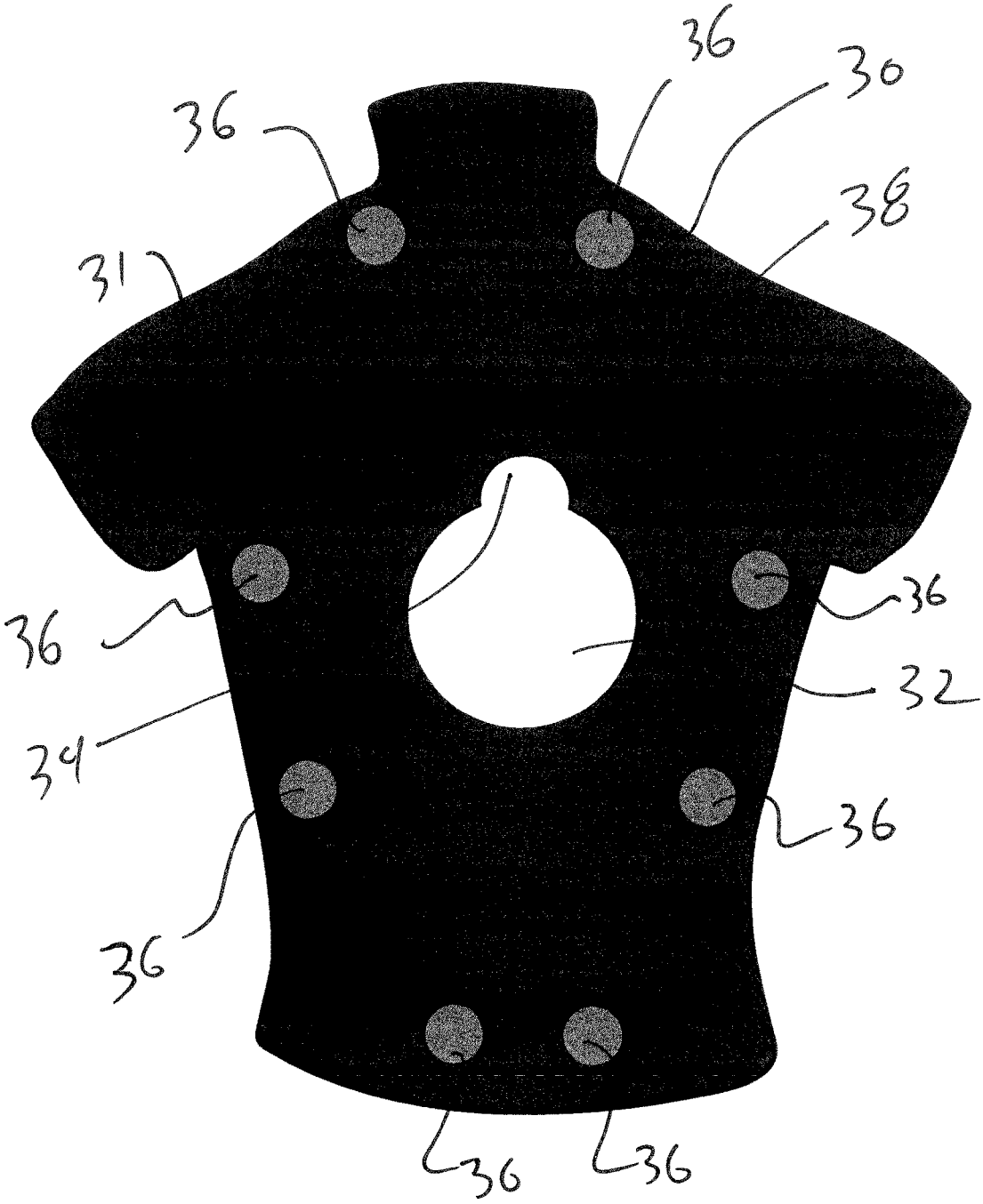
FIG. 3 shows a front view of a backboard for use with a three-dimensional apparel base according to at least one embodiment of the present disclosure.

FIG. 3 shows a front view of backboard 30, according to at least one embodiment of the present disclosure. In at least one embodiment, backboard 30 comprises a rigid sheet of material, such as wood, fiberboard, cardboard, plastic, fiberglass, aluminum, and the like. As shown in FIG. 3, backboard 30 comprises perimeter 31. The contours of the perimeter 31 of backboard 30 match the contours of rim 22 of three-dimensional apparel base 10.

In at least one embodiment of the present disclosure, backboard 30 comprises aperture 32, which extends through backboard 30. In at least one embodiment, aperture 32 further comprises notch 34, which is centered on backboard 30 and oriented upwardly. In at least one other embodiment, backboard 30 does not include notch 34.

In at least one embodiment of the present disclosure, anterior surface 38 of backboard 30 comprises a plurality of magnets 36. Magnets 36 are arranged on backboard 30 near rim 31, in positions corresponding to attachment points 24 of three-dimensional apparel base 10. In the embodiment of three-dimensional apparel base 10 shown in FIG. 2, eight magnets 36 are shown. However, it is within the scope of present disclosure to have more than eight magnets 36 or fewer than eight magnets 36 in embodiments of backboard 30. It also is within the scope of the present disclosure to have more magnets 36 on backboard 30 than there are attachment points 24 on three-dimensional apparel base 10, or fewer magnets 36 on backboard 30 than there are attachment points 24 on three-dimensional apparel base 10.

Figure 4:
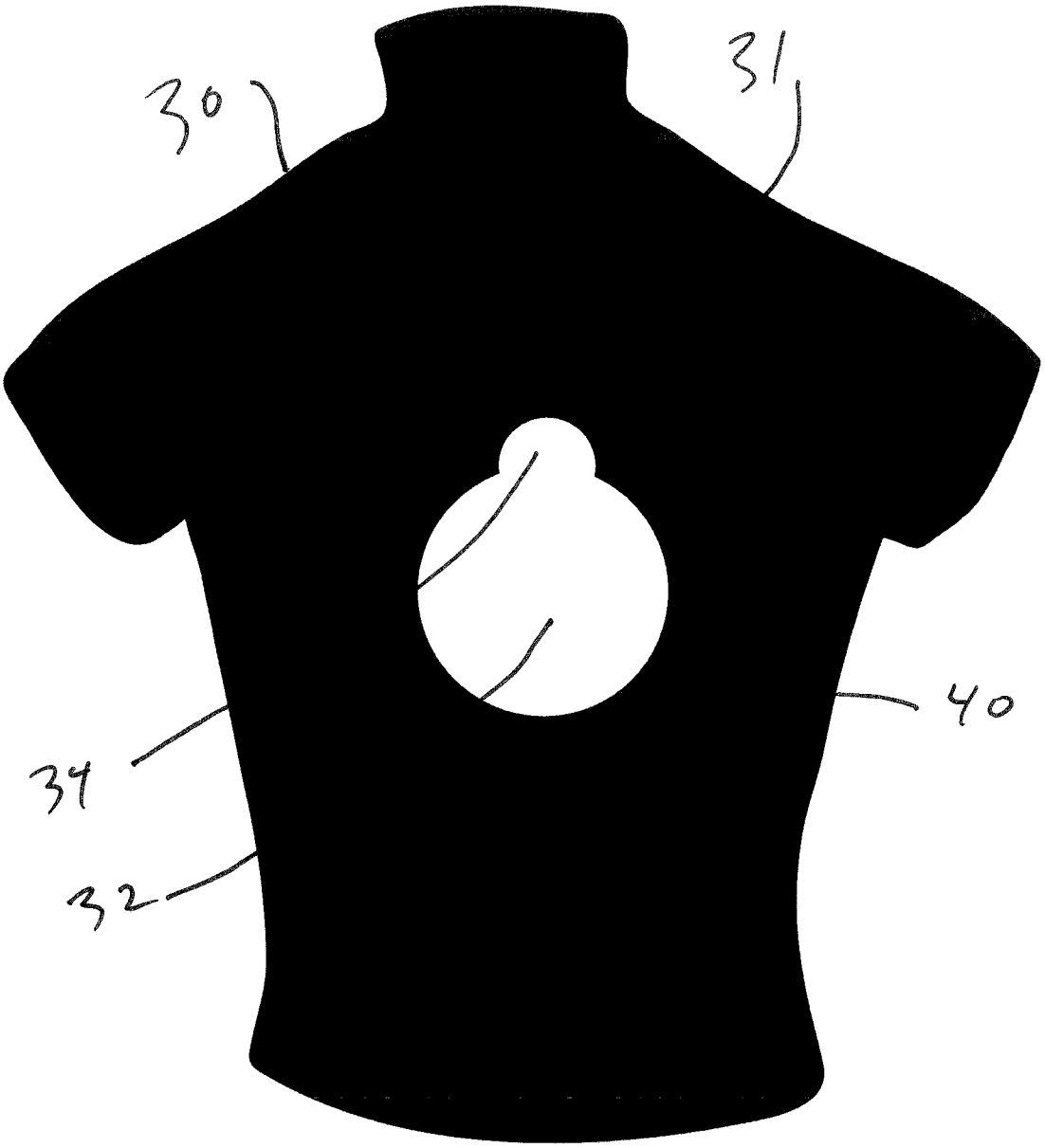
FIG. 4 shows a rear view of a backboard for use with a three-dimensional apparel base according to at least one embodiment of the present disclosure.

FIG. 4 shows a rear view of backboard 30, according to at least one embodiment of the present disclosure. Posterior surface 40 of backboard 30 is shown on FIG. 4.

Figure 5:
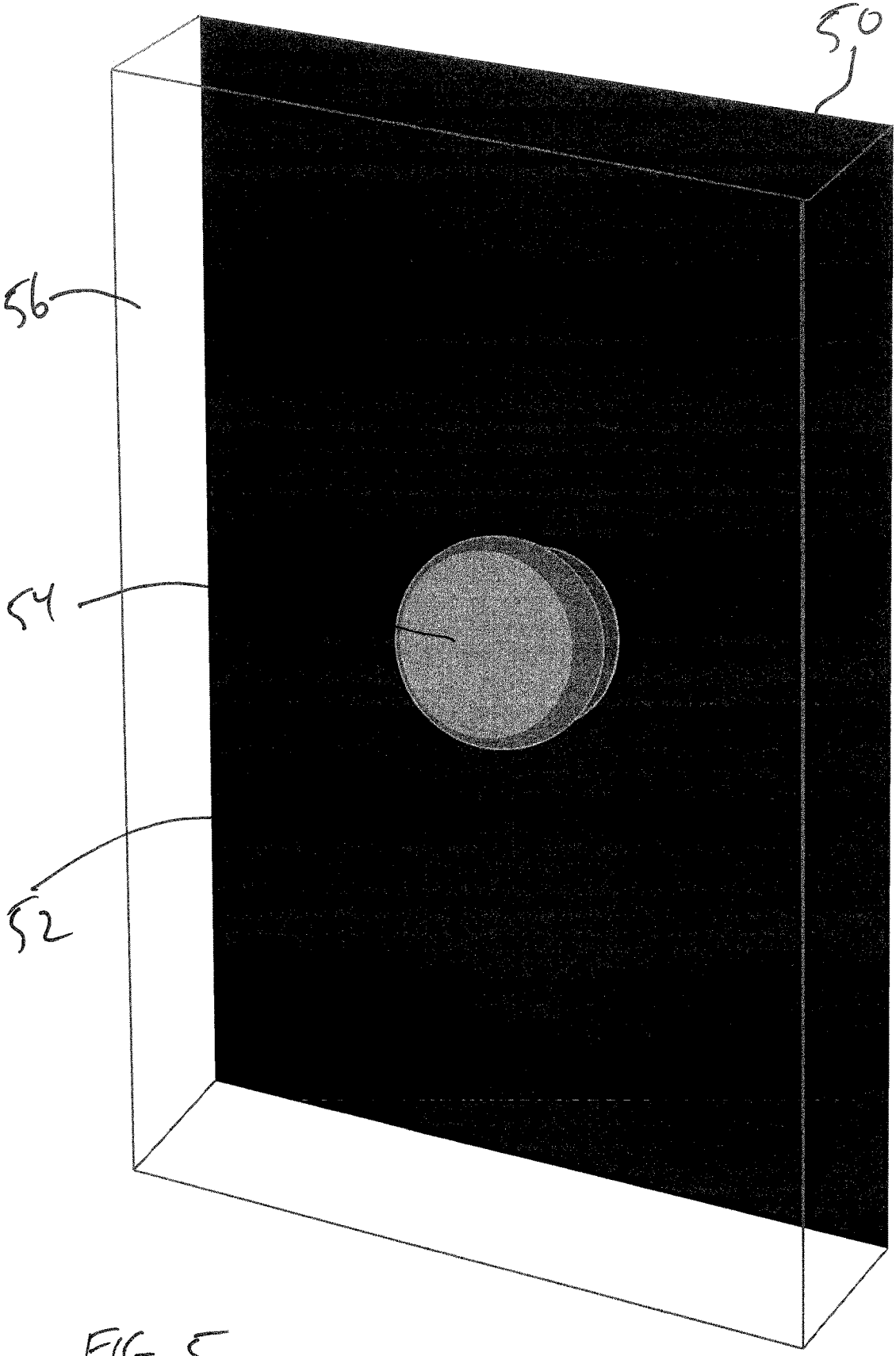
FIG. 5 shows a display case according to at least one embodiment of the present disclosure.
Figure 6:
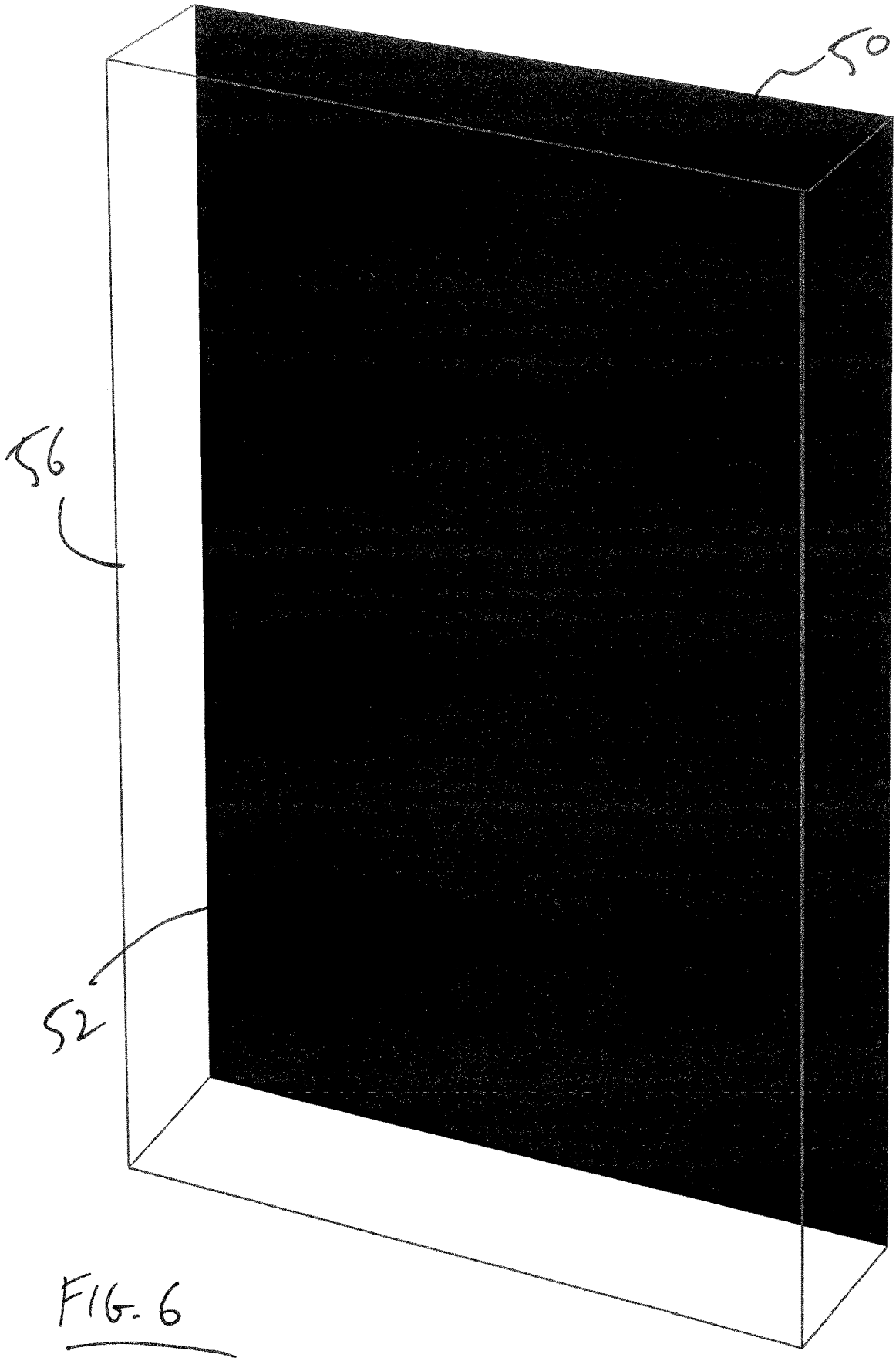
FIG. 6 shows a display case according to at least one embodiment of the present disclosure.

FIGS. 5-6 shows display case 50, according to at least one embodiment of the present disclosure. In the embodiment shown in FIG. 5, display case 50 comprises frame 52, upon which hanging knob 54 is mounted. In the embodiment shown in FIG. 6, hanging knob 54 is not included. The embodiments of display case 50 shown in FIGS. 5-6 also include enclosure 56. Enclosure 56 is a three-dimensional enclosure, which typically is constructed of a clear material such as plastic or glass. When connected to frame 52, enclosure 56 encloses the contents of display case 50, while allowing them to be viewed through enclosure 56.

Figure 7:
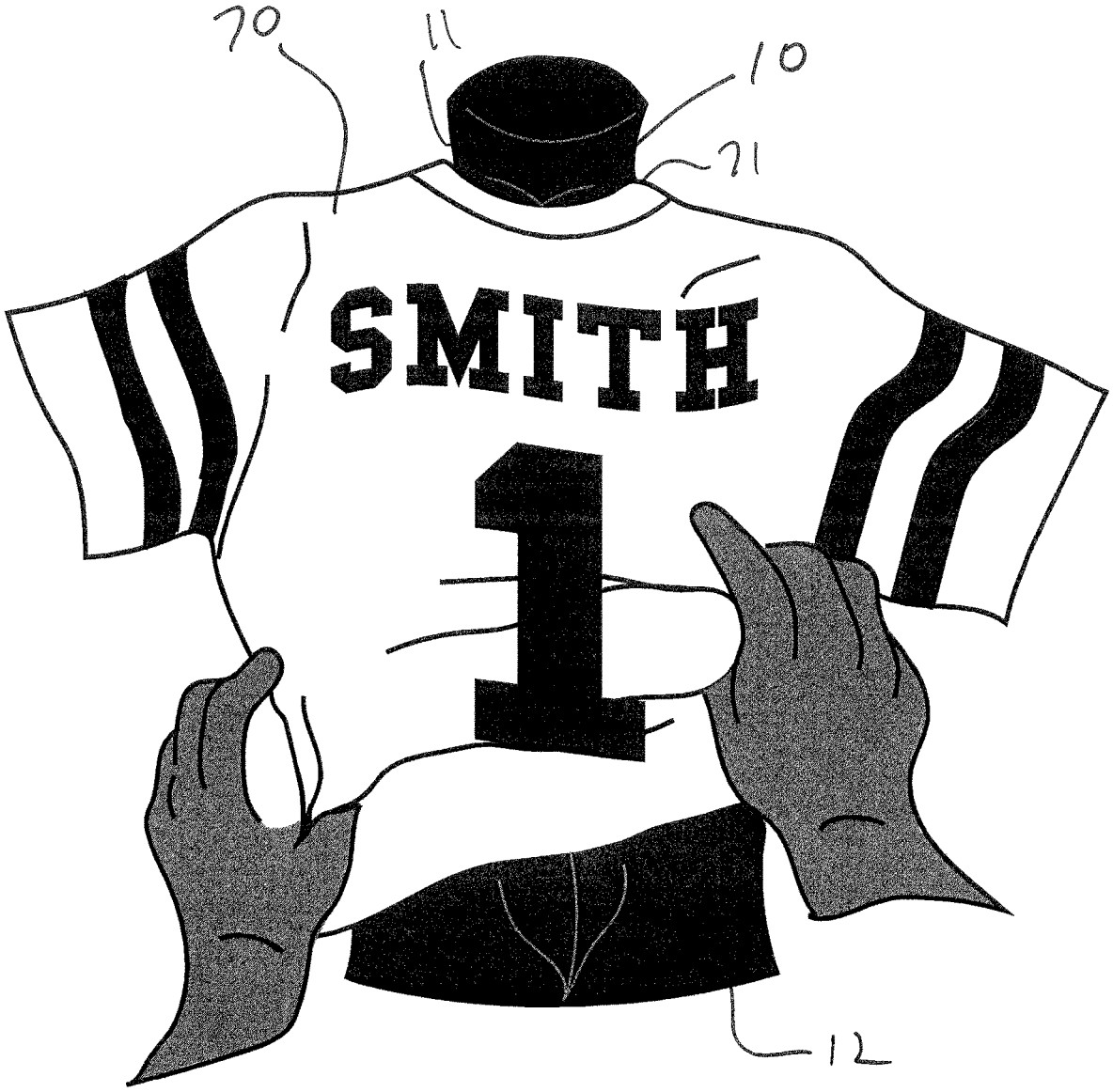
FIG. 7 shows the operation of an apparatus for displaying apparel according to at least one embodiment of the present disclosure.

FIGS. 7-11 show the operation of an apparatus for displaying apparel according to at least one embodiment of the present disclosure. As shown in FIG. 7, collectable apparel article 70 is installed over three-dimensional apparel base 10. Neck 11 of 3-dimensional display 10 protrudes through neck hole 71 of collectable apparel article 70. The portion of collectable apparel article 70 that is intended for display is oriented in the same direction as front surface 12 of three-dimensional apparel base 10.

Figure 8:
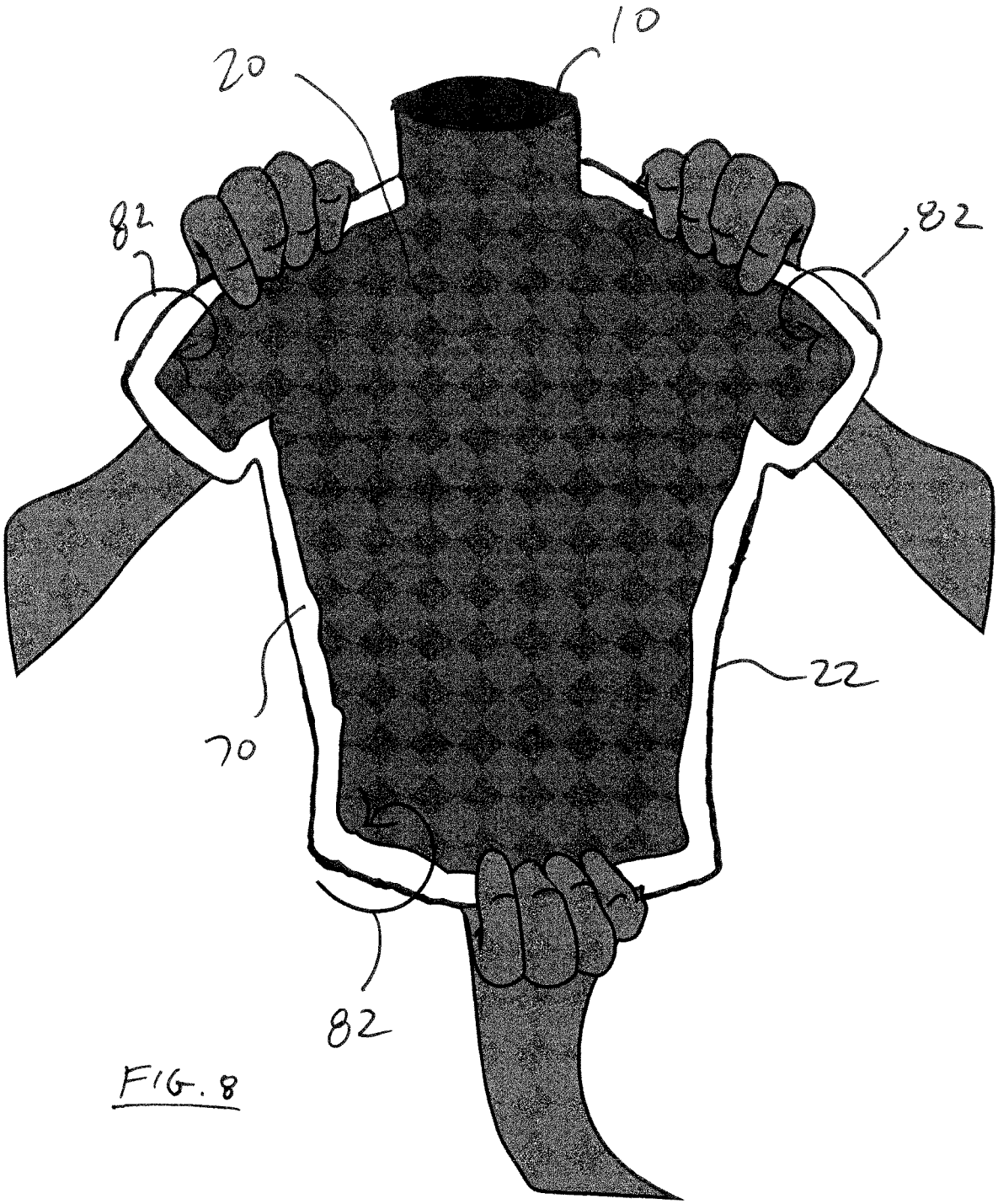
FIG. 8 shows the operation of an apparatus for displaying apparel according to at least one embodiment of the present disclosure.

FIG. 8 shows a rear view of collectable apparel article 70 on three-dimensional apparel base 10, with the rear portion of collectable apparel article 70 cutaway for clarity. As shown in FIG. 8, the collectable apparel article 70 is wrapped around rim 22 of three-dimensional apparel base 10, in the matter indicated by arrows 82. The excess material of collectable apparel article 70 is stowed in the concave rear portion of three-dimensional apparel base 10, so that the aesthetic appearance of the portion of collectable apparel article 70 that is intended for display is as desired.

Figure 9:
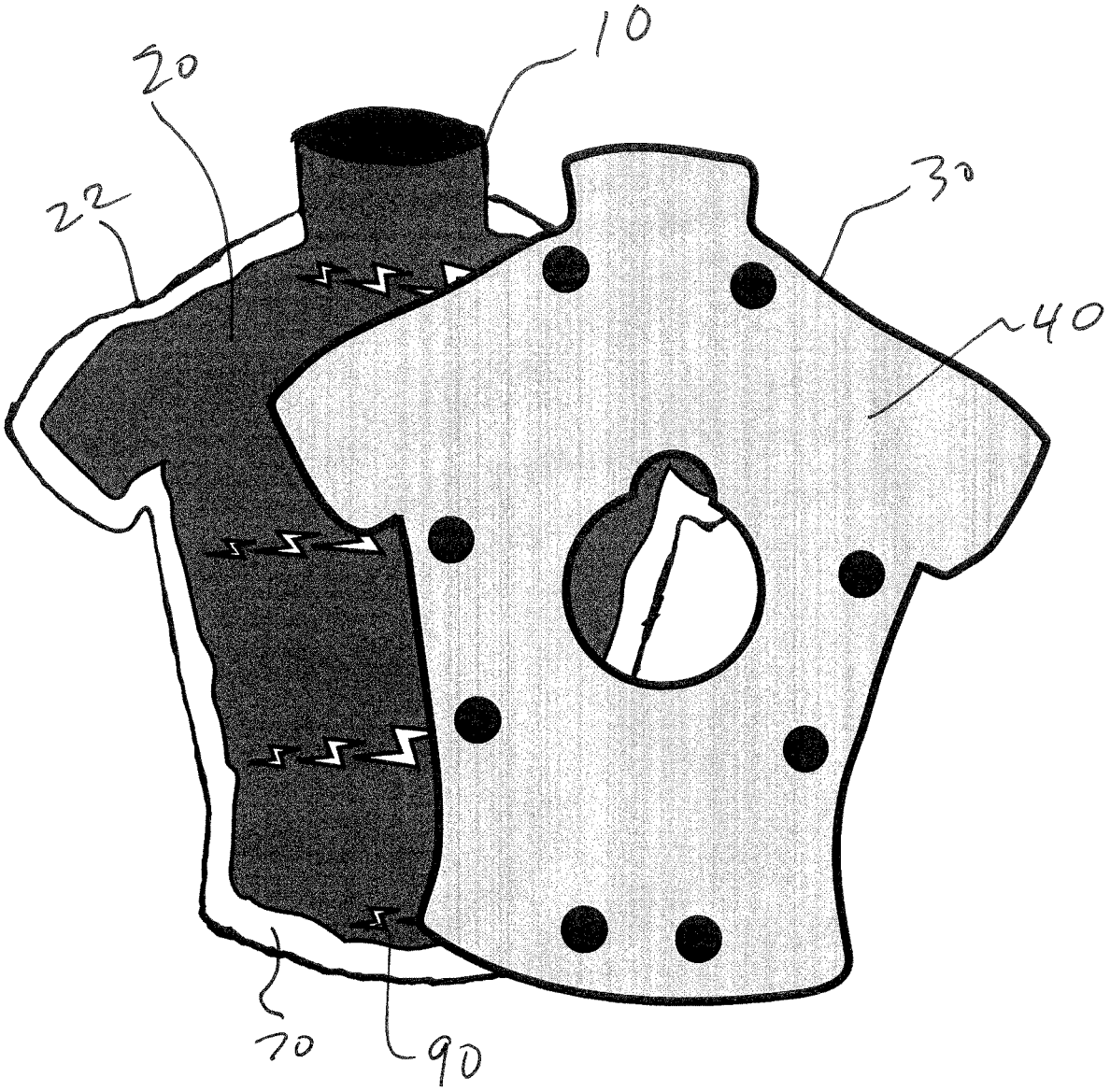
FIG. 9 shows the operation of an apparatus for displaying apparel according to at least one embodiment of the present disclosure.

FIG. 9 shows the attachment of backboard 30 to three-dimensional apparel base 10. As shown in FIG. 9, while collectable apparel article 70 is tucked around rim 22 of three-dimensional apparel base 10, with the excess material of collectable apparel article 70 being stowed within the concave rear portion of three-dimensional apparel base 10, backboard 30 is attached to three-dimensional apparel base 10. Magnets 36 of backboard 30 are coupled to attachment points 24 of three-dimensional apparel base 10, with the magnetic attraction indicated by items 90 in FIG. 9.

As shown in FIG. 10, after backboard 30 is attached to three-dimensional apparel base 10, collectable apparel article 70 may still be adjusted on three-dimensional apparel base 10. Aperture 32 provides access to the collectable apparel article 70 within the concave rear portion of three-dimensional apparel base 10. For example, if collectable apparel article 70 became loose during the attachment of backboard 30 to three-dimensional apparel base 10 such that the aesthetic appearance of collectable apparel article 70 on three-dimensional apparel base 10 was less than desired, collectable apparel article 70 may be adjusted through aperture 32 in order to improve its aesthetic appearance.

Figure 11:
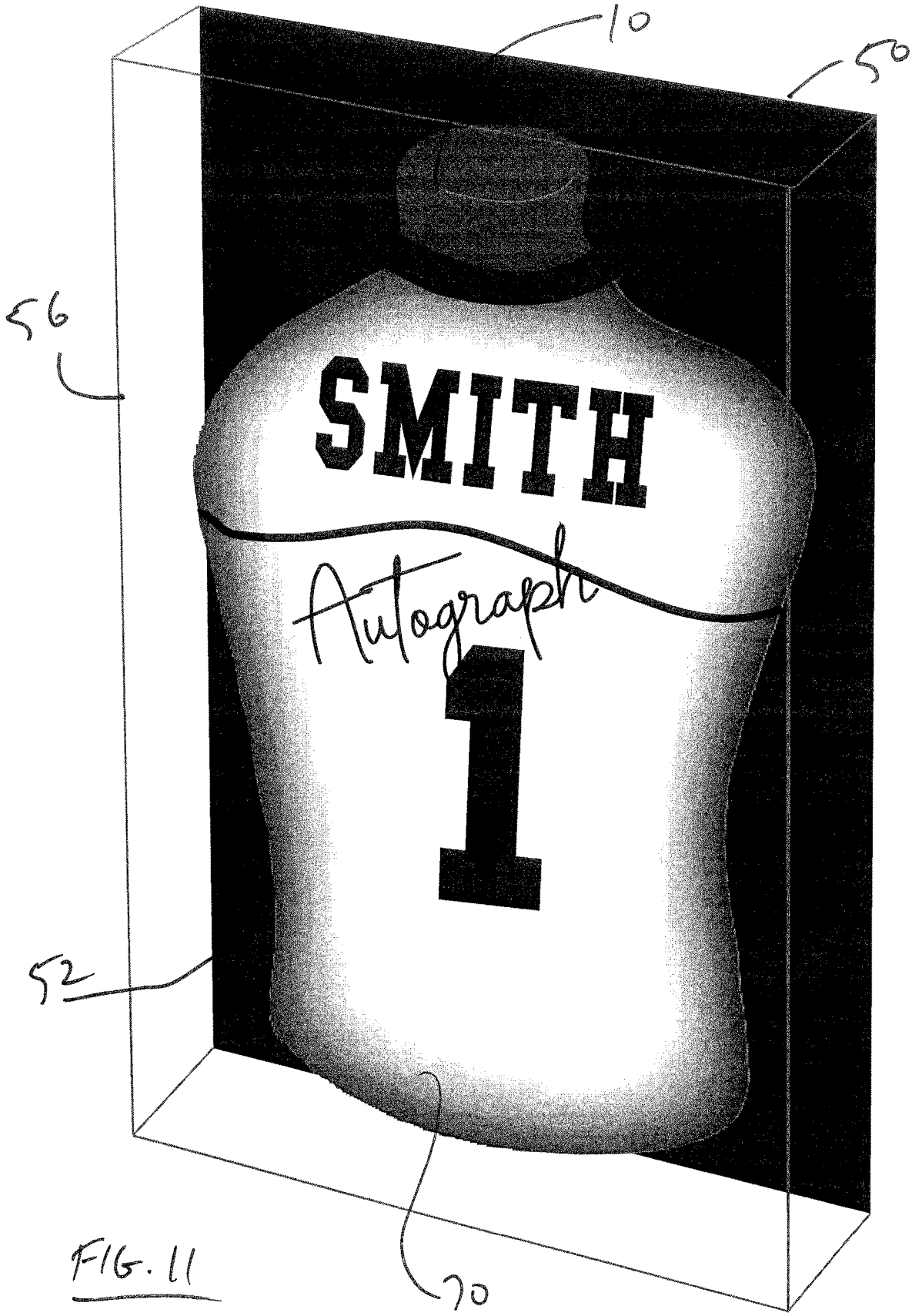
FIG. 11 shows the operation of an apparatus for displaying apparel according to at least one embodiment of the present disclosure.

FIG. 11 shows three-dimensional apparel base 10 with backboard 30 attached thereto and with collectable apparel article 70 mounted thereon, as installed in display case 50. In an embodiment of display case 50 such as the embodiment shown in FIG. 5, hanging knob 54 is inserted through hole 32 in backboard 30. Notch 34 then engages with hanging knob 54 to secure three-dimensional apparel base 10 with backboard 30 and collectable apparel article 70 in place against frame 52. In an embodiment of display case 50 such as the embodiment shown in FIG. 6, backboard 30 is magnetically adhered to frame 52, which secures three-dimensional apparel base 10 with backboard 30 and collectable apparel article 70 in place. Enclosure 56 then is installed over three-dimensional apparel base 10 with backboard 30 and collectable apparel article 70 to create the finished apparatus for displaying apparel.

While this disclosure has been described as having preferred designs, the apparatus and methods according to the present disclosure can be further modified within the scope and spirit of this disclosure. This application is therefore intended to cover any variations, uses, or adaptations of the disclosure using its general principles. For example, any method disclosed herein and in the appended claims represent one possible sequence of performing the steps thereof. A practitioner may determine in a particular implementation that a plurality of steps of one or more of the disclosed methods may be combinable, or that a different sequence of steps may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains.

I claim:

1. An apparatus for displaying apparel, the apparatus comprising:

a three-dimensional apparel base, said three-dimensional apparel base comprising a convex front surface and an opposing concave rear surface, at least a portion of said concave rear surface terminating in a rim, said three-dimensional apparel base comprising a plurality of magnetically active attachment points arranged adjacent to said rim;

a backboard, said backboard comprising a perimeter, an anterior surface, an opposing posterior surface, and a plurality of magnets arranged on said anterior surface adjacent to said perimeter, said backboard magnetically coupled to said three-dimensional apparel base by way of magnetic connections between two or more of said plurality of magnets and two or more of said plurality of magnetically active attachment points; and a display case, said display case comprising a frame and an enclosure, wherein said posterior surface of said backboard is removably affixed to said frame and said enclosure covers said three-dimensional apparel base and said backboard.

2. The apparatus of claim 1, wherein said convex front surface comprises a replica of the back torso of a male human.

3. The apparatus of claim 1, wherein said convex front surface comprises a replica of the front torso of a male human.

4. The apparatus of claim 1, wherein said convex front surface comprises a replica of the back torso of a female human.

5. The apparatus of claim 1, wherein said convex front surface comprises a replica of the front torso of a female human.

6. The apparatus of claim 1, wherein said backboard comprises an aperture therethrough.

7. The apparatus of claim 6, wherein said aperture comprises a notch.

8. The apparatus of claim 7, wherein said frame comprises a hanging knob, and wherein said posterior surface of said backboard is removably affixed to said frame by engaging said hanging knob and said notch.

9. The apparatus of claim 1, wherein said frame comprises a hanging knob.

10. The apparatus of claim 1, wherein said posterior surface of said backboard is removably affixed to said frame by magnetic forces.

11. A method for displaying apparel, the method comprising the steps of:

providing a three-dimensional apparel base, said three-dimensional apparel base comprising a convex front surface and an opposing concave rear surface, at least a portion of said concave rear surface terminating in a rim, said three-dimensional apparel base comprising a plurality of magnetically active attachment points arranged adjacent to said rim;

installing an article of apparel over the three-dimensional apparel base;

stowing any excess material from said article of apparel in said concave rear surface;

coupling a backboard to said three-dimensional apparel base in a manner securing said article of apparel in place, said backboard comprising a perimeter, an anterior surface, an opposing posterior surface, and a plurality of magnets arranged on said anterior surface adjacent to said perimeter, said backboard coupling to said three-dimensional apparel base by way of magnetic connections between two or more of said plurality of magnets and two or more of said plurality of magnetically active attachment points; and installing said article of apparel, said three-dimensional apparel base, and said backboard into said a display case, said display case comprising a frame and an enclosure, wherein said posterior surface of said backboard is removably affixed to said frame and said enclosure covers said article of apparel, said three-dimensional apparel base, and said backboard.

12. The method of claim 11, wherein said convex front surface comprises a replica of the back torso of a male human.

13. The method of claim 11, wherein said convex front surface comprises a replica of the front torso of a male human.

14. The method of claim 11, wherein said convex front surface comprises a replica of the back torso of a female human.

15. The method of claim 11, wherein said convex front surface comprises a replica of the front torso of a female human.

16. The method of claim 11, wherein said backboard comprises an aperture therethrough.

17. The method of claim 16, wherein said aperture comprises a notch.

18. The method of claim 17, wherein said frame comprises a hanging knob, and wherein said posterior surface of said backboard is removably affixed to said frame by engaging said hanging knob and said notch.

19. The method of claim 11, wherein said frame comprises a hanging knob.

20. The method of claim 11, wherein said posterior surface of said backboard is removably affixed to said frame by magnetic forces.

* * * * *